United States Patent [19]

James

[11] Patent Number: 4,918,771

[45] Date of Patent: Apr. 24, 1990

[54] PATIENT LIFTING AND HOIST THEREFOR

[75] Inventor: David R. James, Glenyard, England

[73] Assignee: James Industries Limited, Gloucester, England

[21] Appl. No.: 615,305

[22] Filed: May 30, 1984

[30] Foreign Application Priority Data

Jun. 2, 1983 [GB] United Kingdom ..... 8315121

[51] Int. Cl.[5] ..... A61G 7/10

[52] U.S. Cl. ..... 5/81 R; 5/83; 5/86

[58] Field of Search ..... 5/81 R, 83, 86, 87, 5/89

[56] References Cited

U.S. PATENT DOCUMENTS

| | | | |
|---|---|---|---|
| 2,914,110 | 11/1959 | Schulte | 5/81 R X |
| 3,277,502 | 10/1966 | Wauthier | 5/81 R |
| 3,623,169 | 11/1971 | James | 5/81 R |
| 3,629,880 | 12/1971 | van Rhyn | 5/86 |
| 3,694,829 | 10/1972 | Bakker | 5/86 X |
| 4,157,593 | 6/1979 | Kristensson | 5/86 X |

*Primary Examiner*—Michael F. Trettel

*Attorney, Agent, or Firm*—Collard, Roe & Galgano

[57] ABSTRACT

A novel method of lifting a patient from a seated to a generally standing position employs a hoist comprising a support column mounted on a mobile chassis. A pivotal lifting arm arrangement projects from the column and presents laterally spaced attachment points for a padded sling which is passed around the back of the seated patient below the arms thereof. The hoist is positioned with knee abutment means, which are mounted on the column, located against the knees of the patient; and the feet of the patient are placed on footrests mounted on the chassis on opposite sides of the column. A lifting mechanism comprises a pivotal operating lever connected to the arm arrangement through a mechanical linkage which provides a mechanical advantage, such that operative movement of the lever through 180° from an upwardly projecting to a downwardly projecting position pivots the arm arrangement upwardly through an angle of say 60° to 65° thereby raising the seated patient to a standing position on the footrests while suppported at the back and laterally located by the sling.

27 Claims, 5 Drawing Sheets

PATIENT LIFTING AND HOIST THEREFOR

BACKGROUND OF THE INVENTION

1. Field of the Invention

The invention relates to the lifting of invalid patients, which term includes infirm and disabled persons generally. It is particularly concerned with raising such patients from a sitting to a generally standing position, especially but not exclusively as part of a toileting procedure, and with hoists adapted for so raising patients.

Putting to the toilet of an elderly or infirm patient involves two difficult and dangerous lifting tasks usually performed by a team of three nurses; two of the latter co-operate in lifting the patient and the third removes necessary clothing, particularly trousers and underclothing, cleans the patient after toileting and replaces the clothing. Typically such a patient requires toileting on a commode or WC five (or more) times a day, every day, involving at least ten lifts. Not only is this expensive in terms of nursing time but, as a consequence of undertaking this task, many thousands of nurses in the UK alone suffer serious and permanent back injury.

2. Description of the Prior Art

Even though mechanical aids have been available for some years to assist in the toileting task they have not been widely accepted and the task is normally still performed manually as described above. The lack of acceptance of the aids available stems from a number of disadvantages. A first disadvantage is that most such aids are excessively complex to operate, so that busy nurses will not take the trouble to use them. A second disadvantage is that most aids do little or nothing to solve the problem of holding up a patient in such manner that the nurse can readily deal with clothing removal and cleaning of the patient; in fact such aids assume that the patient will not be wearing underclothing. A further disadvantage is that in addition to obstructing clothing removal the hoist aids which have been used or proposed in general tend to be uncomfortable for the patient if suitably held in the raised position for the requisite length of time.

In the customary manual performance of the toileting task, the patient is lifted from the sitting position on a chair by two nurses who stand facing the patient one on either side. Each of these nurses uses an arm placed around the back of the patient and under the adjacent arm of the latter to effect the lift. Once lifted and held in the standing position the third nurse involved removes the chair on which the patient was sitting, removes trousers if worn and lowers the patient's underclothing and wheels in a second chair which may be a commode chair or wheelchair. If a wheelchair the latter is used to transport the patient to a WC where the lift is repeated, both before and after toileting and then again back to an easy chair. Thus the complete procedure may involve not two but a total of four lifts per toileting cycle.

SUMMARY OF THE INVENTION

A principal object of the invention is to provide a method of lifting a patient from a sitting to a generally standing position, and hoists for so raising a patient, which largely overcome the disadvantages of prior methods and hoists. A specific object is to provide such a hoist which is relatively cheap to manufacture, which is of conveniently light and compact form, and which is simple to operate.

Another object of the invention is to lift the patient in an almost identical manner to that employed in the usual manual lift but using simple mechanics to take all the strain out of the task, and to provide a hoist which will enable a single nurse to carry out the toileting task and thus, by its use, perform the work of three nurses at present and without risk of personal injury.

According to one aspect of the invention the patient is lifted employing a hoist with a lifting arm arrangement presenting laterally spaced sling attachment points, the method of lifting comprising positioning the feet of the patient on a footplate or footrests of the hoist with the legs below the knees substantially vertical, passing a sling around the back of the patient underneath the arms thereof and, with the sling attached to said attachment points, moving said attachment points upwardly through an arc relative to the position of the feet which arc has an effective radius comparable to the length of the thigh bone of the patient whereby to raise the latter to a generally standing position on the footplate or footrests while supported and laterally located by the sling, said arc being centred about a point which remains fixed relative to the footplate or footrests and more or less directly above the heel position of the patient.

Preferably the footplate or footrests remain stationary during the lifting movement with the lifting arm arrangement pivoting about a horizontal fixed axis. The knees of the patient may initially be located against knee abutment means of the hoist.

In the method of the invention the sling is passed around the back of the patient in the same manner as would be the arms of two nurses and, being padded, it simulates the muscular padding of the nurses' arms. As the radius of said arc is of comparable length to the thigh bone the lifting arm arrangement corresponds to the upper limb of a parallelogram the lower limb of which is provided by the thigh bone itself. The result is that the lifting is performed with no horizontal force tending to displace the knees. As the knees are not displaced but can remain at rest against the knee abutment means the lower legs remains vertical thus ensuring that their own weight and half the thigh weight is supported by the feet on the footplate or footrests and there is no transference of this weight to be taken by the sling. This is an important feature contributing to patient comfort as it minimises the pressure on the body of the sling in lifting the balance, which is approximately 60% of the body weight.

According to another aspect of the invention a hoist comprises an upstanding support structure such as a column, a lifting arm arrangement projecting from the support structure and providing laterally spaced attachment points for the attachment of a body support sling positioned around the back of the patient below the arms thereof, a footplate or footrests on or attached to the support structure, and a lifting mechanism operative to raise the lifting arm arrangement in such manner that the attachment points thereof move along a generally arcuate path centred about a point disposed above the footplate or footrests with the relative positioning of that point and the footplate or footrests remaining unchanged, such movement of the lifting arm arrangement being sufficient to raise the patient to a standing position with the footplate or footrests supporting a substantial part of the total body weight of the patient while the latter is also supported and laterally located in the standing position by said sling.

Preferably the footplate or footrests is or are fixed relative to the support structure and the lifting arm is pivotally mounted on the support structure for movement about a fixed horizontal axis. Knee abutment means, for location of the knees of the patient, may be mounted on the support structure.

Thus a hoist in accordance with the invention preferably comprises an upstanding support structure such as a column, a pivotal lifting arm arrangement projecting from one side of the column and providing laterally spaced attachment points for the attachment of a padded body support sling passed around the back of the invalid below the arms thereof, knee location abutments means on the support structure, a footplate or footrests on or attached to the support structure and a lifting mechanism operative to raise the lifting arm arrangement about a fixed horizontal pivot axis through an angle sufficient to raise the patient, with the knees of the latter located against said abutment means, to the standing position on the footplate or footrests whilst supported from behind and laterally located by the sling.

Preferably the support structure is mounted on a mobile chassis so that the hoist can be wheeled up to a seated patient and, after the latter has been raised to a standing position, transport the patient to a different location, for example to a toilet or from a bed to a chair. In this case the arm arrangement will project over the chassis, which will normally be a U-shaped chassis open at the front and with side members which may be of adjustable spacing. The footrests may be provided on a cross member of the chassis on either side of a central column of the support structure, or the latter may comprise an upper central column portion and a lower portion of inverted U-shape with spaced upright members respectively mounted on the chassis side members between which said footplate extends.

The sling may be a simple padded sling passing around the back and under the armpits of the patient, which has the advantage that the lower body is left unrestricted for clothing removal prior to toileting. The length and lower resting position of the arm arrangement may be adjustable to suit the height of the patient and additionally, or alternatively, different patient heights may be accommodated by using different effective lengths of sling. It is envisaged that a range of three different sling lengths will enable most patients to be handled without arm length adjustment. A set of slings of differing length may be provided, or the effective length of a single sling may be variable at its end attachments to said sling attachment means. Adjustment may also be provided at the support structure, for example by employing a telescopic column.

The arm arrangement may incorporate hand grips for the patient, to provide a feeling of security for the latter and also to enable a patient with some strength in the arms to assist in the body raising movement. A seat support sling may additionally or alternatively be employed, this sling having additional end attachments by which it is "tied back" to the support structure to prevent this sling slipping off the patient as the standing position is achieved. When the patient has adequate arm strength such a seat sling may be used alone, and when it is used for additional support during lifting it can be removed when the patient has been raised thus leaving the lower body portion free and the patient supported by the back sling.

Said lifting mechanism may be of any desired form, but it is preferably mechanical and manually operated with an operating lever pivotally mounted at the opposite side of the support structure, ie the side opposite to the lifting arm arrangement. A mechanical linkage between the operating lever and the lifting arm arrangement preferably provides a mechanical advantage such that the lever moves downwardly, through substantially 180° to effect the arm lifting movement which is conveniently of the order of 60°-65°. The mechanical linkage may include an over-centre device such that the lifting mechanism is self-locking in the arm-raised position and/or a clip or catch may be provided to retain the operating lever against accidental displacement when in the patient-raised position.

The lifting arm arrangement may comprise an inner end central portion directly coupled to the lifting mechanism and two laterally-spaced end portions with end sling attachment hooks and which are spaced apart by a distance which approximates to the shoulder width of a typical patient. The inner and outer arm portions may be articulated for said arm height adjustment, which may be provided by an eccentric rotary cam.

In some circumstances it may be deemed desirable to provide damping means operative to lower the patient gently if the operating lever is inadvertently released during raising or lowering of the patient.

A hydraulic lifting mechanism may alternatively be employed with a hydraulic strut which supports the lifting arm arrangement and operates as a hydraulic ram to effect the raising arm movement.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be made as desired by those skilled in the art without departing from the present invention and the purview of the appended claims.

DESCRIPTION OF THE PREFERRED EMBODIMENTS

Figure 1:
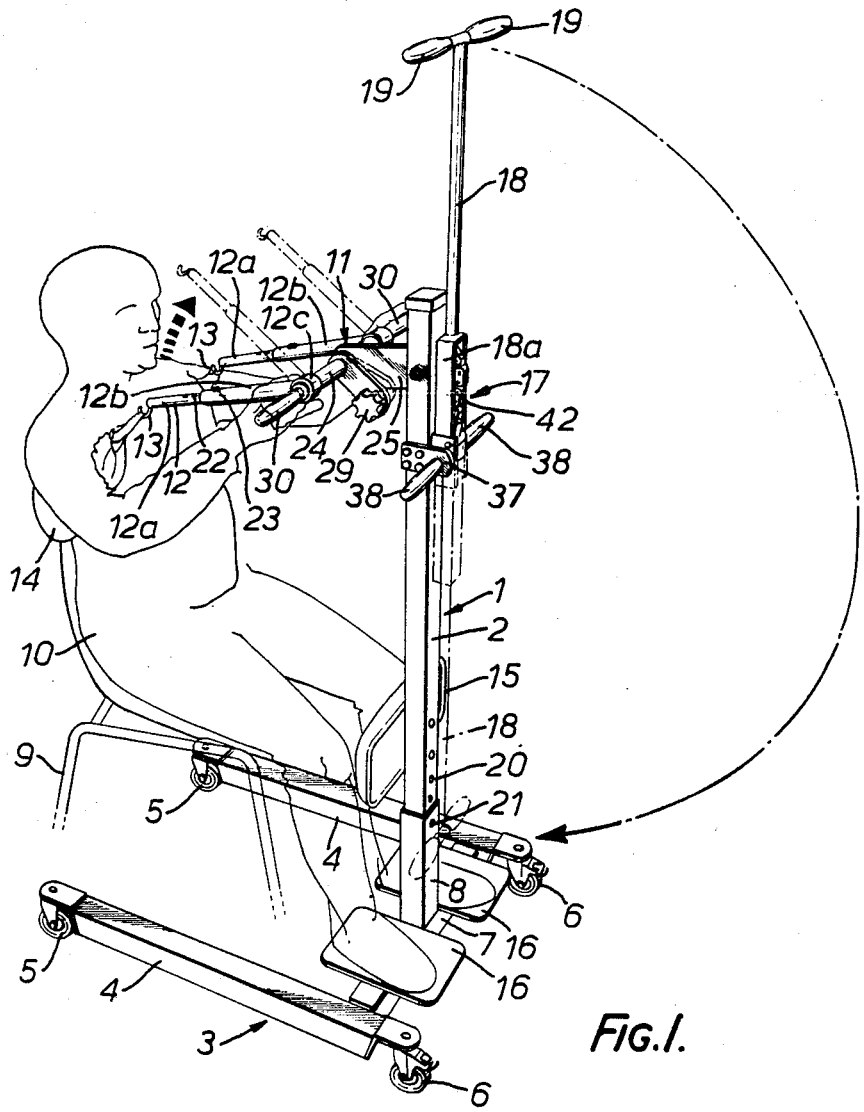
FIG. 1 is a rear perspective view of one embodiment of the invention.
Figure 2:
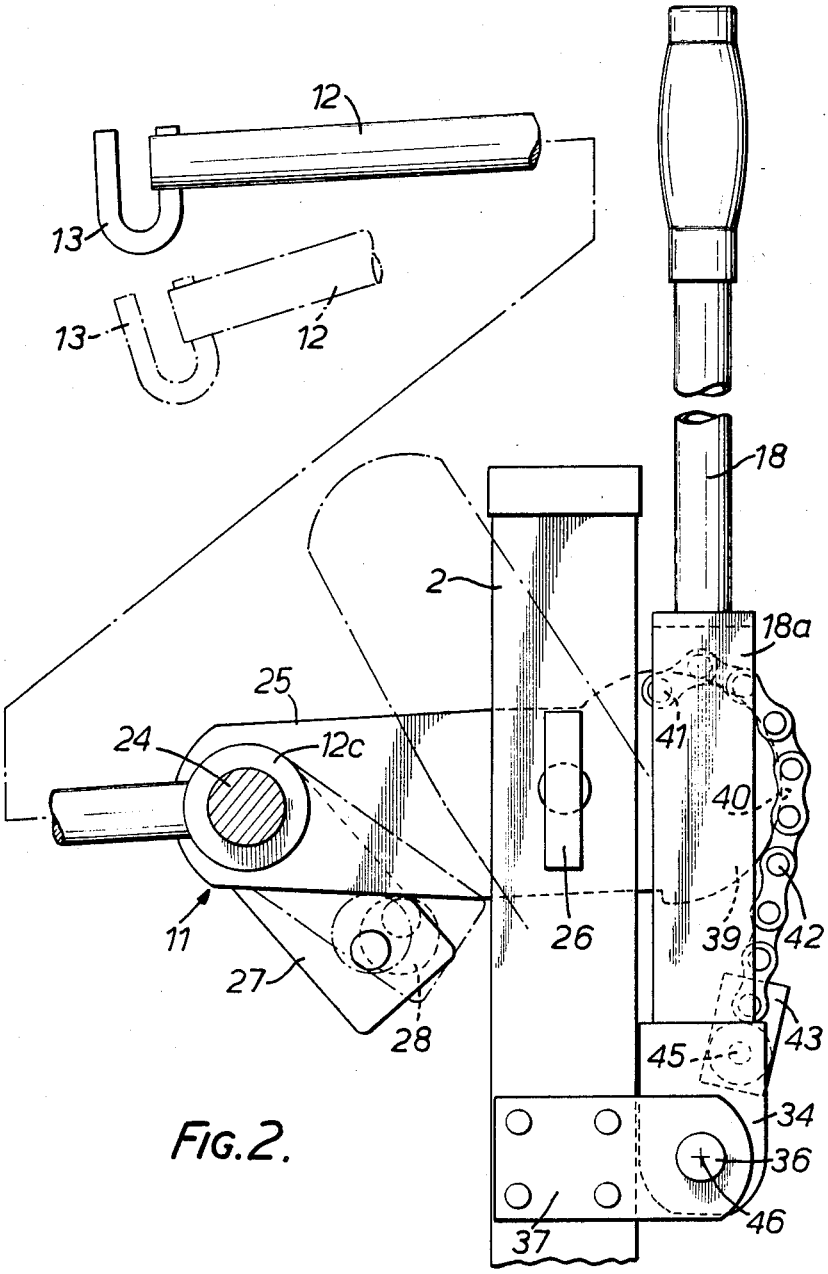
FIGS. 2 and 3 are respectively side and rear detail views of the lifting mechanism of this embodiment.
Figure 3:
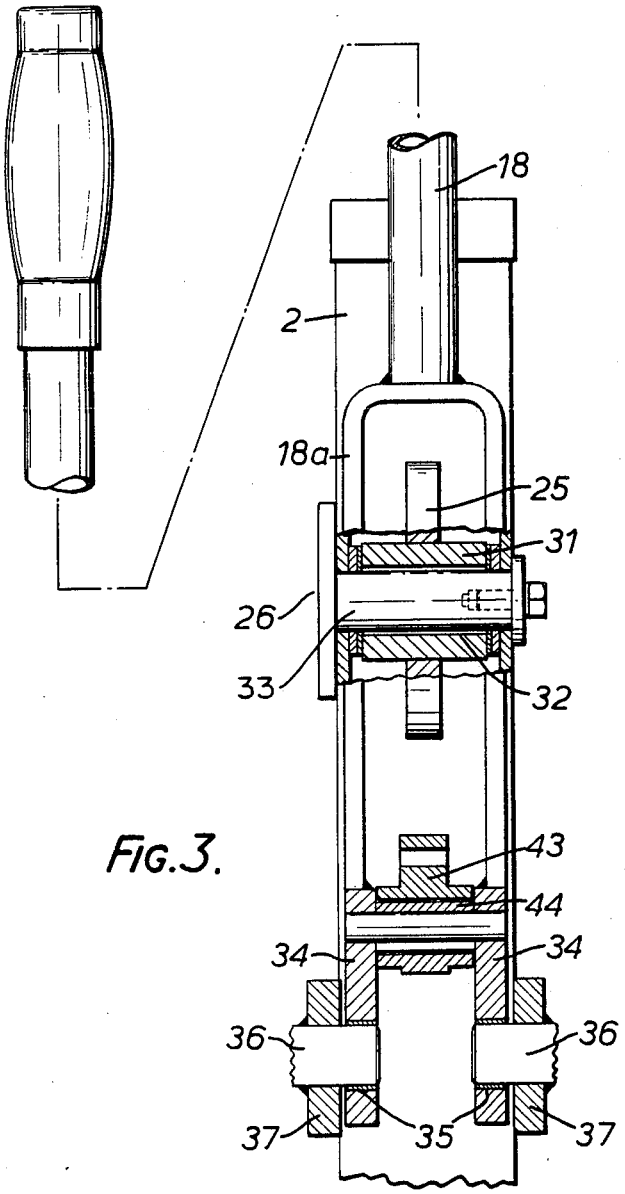

The hoist illustrated in FIGS. 1 to 3 of the drawings has an upstanding support structure 1 comprising a central column 2 mounted on a mobile chassis 3. The chassis 3 has spaced side members 4 with front castors 5 and braked rear castors 6, and a cross member 7 which extends between the side members 4 and supports a socket 8 in which the column 2 is mounted. Thus the chassis 3 is U-shaped and open at the front between the side members 4 so that it can be wheeled around a chair 9 on which the patient 10 to be raised is seated as shown in FIG. 1.

A lifting arm arrangement 11 which projects forwardly at the front of the column 1 above the chassis 3 comprises two laterally spaced outer end portions 12 each of which terminates in a sling attachment hook 13. FIG. 1 illustrates the basic method of lifting with use of a simple padded back sling 14 which is passed around the back and under the armpits of the patient 10 before being hooked on to the hooks 13.

Knee location abutment means are provided by a knee pad 15 mounted on the front of the column 1 for engagement with the knees of the patient 10 during initial positioning of the hoist and during lifting, with the feet of the patient resting on separate footrests 16 mounted on the chassis cross member 7 on opposite sides, respectively, of the socket 8.

A manually-operated and mechanical lifting mechanism 17 comprises an operating lever 18 pivotally mounted at the rear side of the column 1. This lever 18 has end hand grips 19 which allow it to be gripped with both hands by an attendant and moved from the upward vertical position (shown in full lines in FIG. 1) through 180° to the position illustrated in broken lines in which it hangs vertically downwards against the column 2. The full operative movement of the lever 18 raises the lifting arm arrangement 11 through an angle of 60° during which the patient 10 is raised to a standing position on the footrests 16 comfortably supported, in a somewhat backwardly inclined and secure position, by the sling 14. In this position infirm and seriously disabled patients will be supported with the knees still in engagement with the knee pad 15, but patients with sufficient muscular tone will involuntarily straighten the knees and thus be supported with the body completely straight.

As will be appreciated by those skilled in the art the lifting arm arrangement 11 extends from the column 1 for a somewhat shorter distance than is the case with conventional invalid hoists, approximating in length to the thigh length of a typical patient. Thus the main raising movement approximates to a more-or-less parallelogram motion, with the two lower pivots thereof provided by the knee and hip joints of the patient.

Telescopic adjustment of the height of the column 2 is provided, this height being determined by the depth of engagement of the column 2 in the support socket 8. At the lower end the column 2 has a row of holes 20 selectively engageable by a locking pin 21 which passes through the rear wall of the socket 8 and locks the column 2 in the adjusted height position within the socket 8. Similar telescopic adjustment of the length of the spaced lifting arms 12 is provided, outer sections **12*a* thereof engaging telescopically within inner sections 12*b* and having a row of holes 22 engageable by locking pins 23. The arm arrangement 11 and the lifting mechanism 17 are illustrated in some detail in FIG. 2 which, for simplicity, shows the outer end portions 12** as of fixed non-adjustable length.

The outer arm portions 12 are of tubular material and have inner end bosses **12*c* secured to a shaft 24 which is pivotally supported in a central inner arm portion 25, which is relatively short and is of plate material. This inner portion 25 projects through a slot (not shown) in the front wall of the rectangular-section column 2, and it is pivotally supported within the column 2 about a pivot axis at 26. Cheek plates 27 rigidly fixed to the shaft 24 project downwardly on opposite sides of the arm portion 25, and support between them a rotary eccentric cam 28 which can be turned by an external knob 29 (FIG. 1) to adjust the angular position of the cam 28. As will be clear from FIG. 2, the angular position of the cam 28 determines the lower resting position of the arm portions 12 with the eccentricity of the cam providing an appropriate range of adjustment. The uppermost limit of adjustment is shown in full lines, the lowermost adjusted position being shown in broken lines. The central arm portion 25 has an insert bearing boss 31 with a brush 32 which turns on a pivot shaft 33 fixed across the column 2 to define the pivot axis 26**.

Hand grips 30 mounted on the ends of the shaft 24 can be gripped by the patient 10, as shown in FIG. 1, to provide a feeling of security for the latter. They also enable a patient with sufficient muscular strength in the arms to assist in the lifting movement, and in a small number of such cases the back sling 14 may be replaced by a seat sling as later described.

Turning now to the construction of the lifting mechanism 17, the lever 18 has a U-shaped inner end portion **18*a* with thickened end portions 34 having aligned inset bearing bushes 35. The bushes 35 respectively turn on stub shafts 36 which project inwardly from side cheek plates 37 fixed to the side walls of the column 2. The shafts 36 are extended outwardly of the plates 37 where they support hand grips 38** to act as handlebars serving for propulsion and steering of the hoist by an attendant.

The central inner arm portion 25 is extended beyond the pivot axis 26 as a cam portion 39 with an arcuate cam profile 40, and this cam is connected at 31 to the upper end link of an operating roller chain 42. This chain passes around the cam profile 40 and at its lower end is connected to a pivot block 43 which turns on a pivot 44 fixed laterally between the side limbs of the lever portion **18*a*. As can be seen from FIG. 2 the pivot axis 45 of the block 43 will be closer to the column 2, when the lever 18 is vertical, than is the pivot axis 46 of the lever 18. Thus, as the lever 18 reaches its downward or patient-raised position the pivot axis 45 passes over centre and thus the mechanism 17 is effectively self-locking in this raised position. For additional security, to avoid accidental displacement of the lever 18 with the patient in the raised standing position, a retaining clip or catch (not shown) is appropriately mounted on the column 2** and may be of any suitable form.

Figure 4:
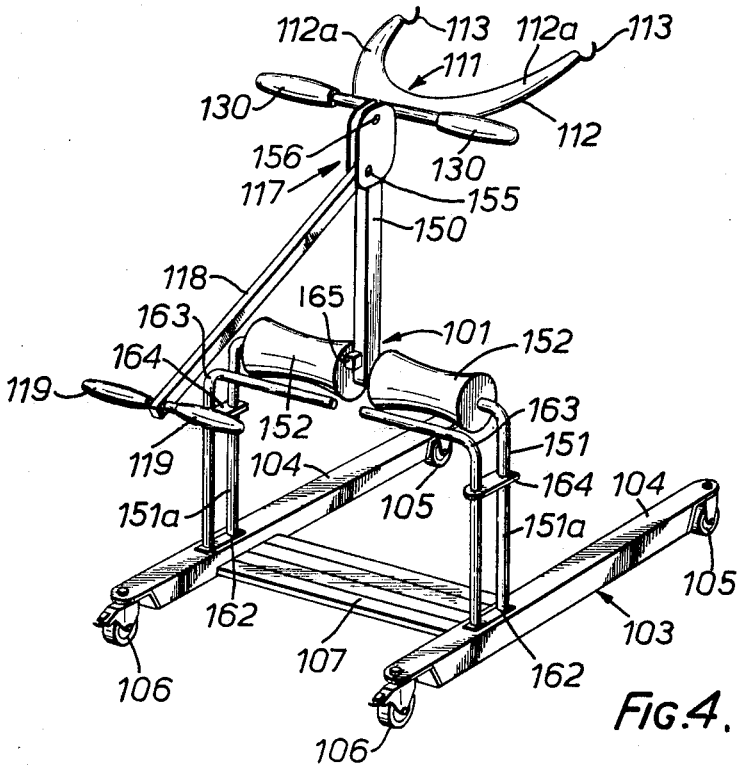
FIG. 4 is a rear perspective view of another hoist embodiment of the invention.
Figure 5:
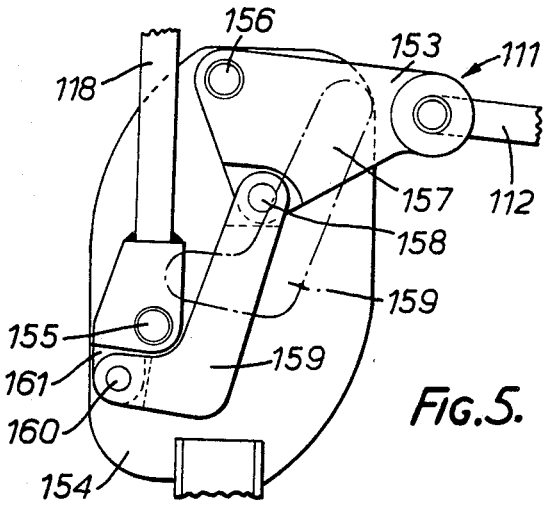
FIG. 5 is a detail view of the lifting mechanism of this other embodiment.

The hoist illustrated in FIGS. 4 and 5 although structurally rather different is functionally similar to the first embodiment, and in particular it lifts a patient to the standing position in an identical manner. A support structure 101 is again mounted on a mobile chassis 103, and a pivotal lifting arm arrangement 111 is raised by a lifting mechanism 117 which is manually operated by means of a lever 118. A U-shaped outer arm section 112 presenting the spaced outer arm portions **112*a* has sling attachment hooks 113, and the chassis cross member 107 which is now underslung with respect to the chassis side members 104 is a comparatively wide plate to provide a footrest for the patient. As before the chassis 103 has front and rear castors 105 and 106, but in this case twin-wheel castors are used for easier propulsion over a carpeted floor, for example. The lever 118 again has end hand grips 119, and patient hand grips are provided at the inner end of the arm section 112**.

Up to this point the description of the second embodiment has utilised for corresponding parts the same reference numerals as that of the first embodiment, but increased in each case by '100'. The main different structural features will now be described. The support structure 101 comprises an upper column portion 150 and a lower tubular portion 151 of inverted U-shape, the latter portion having side limbs 151*a* respectively supported on the chassis side members 104. On each side of the central column portion 150 the upper intermediate limb of the support portion 151 carries a knee pad 152.

The lifting mechanism 117, mounted at the top of the upper column portion 150, uses a pivotal linkage to couple the lever 118 to an inner arm portion 153 (FIG. 5) to which the outer arm portion 112 is rigidly attached. Thus in this case no column height, or arm length or angle, adjustment is provided and different heights of patient are accommodated by use of the appropriate sling length. The linkage is mounted and shrouded between two spaced cheek plates 154 mounted at the top of the upper column portion 150. The operating lever 118 pivots, through 180° as before, on a pivot pin 155 fixed between the cheek plates 154 and the arm arrangement 111 turns on a pivot pin 156 similarly fixed between the plates 154. The arm portion 153 is of generally triangular shape with the pivot 156 adjacent an upper apex thereof, and providing a downwardly-directed portion 157 which is pivotally connected at 158 to the upper end of a dog-leg link 159. The other end of the link 159 is pivoted at 160 to an inner side protuberance 161 on the level 118. At the lower "patient-raised" position of the lever 118 the linkage of this embodiment again goes over-centre to provide a self-locking action, but the provision of a suitable retaining clip or catch 161 is a desirable safety feature. In this embodiment an arm movement of 180° is again employed. An advantage of this embodiment is that the underslung footplate 107 is low enough to be wheeled underneath the folding footrests of a conventional wheelchair in which the patient may be seated. Thus it is a simple matter to lift the feet of the patient, one by one, and to fold up the wheelchair footrests before dropping the feet down on to the footplate 107.

The chassis side members 104 pivot at 162 about the mounting points of the support side limbs 151*a* enabling the operator to increase the chassis front end opening in order to fit around a wheelchair for example, and to reduce it to the normal condition (with the chassis side members 104 parallel) to pass through doorways and the like. Such chassis adjustment is effected by means of operating rods 163 which terminate in lever-like upper ends and which pass through steady bearings 164 in the support portion 151. At their lower ends the levers 163 terminate in rotary eccentric cams which engage slots (not shown) in the chassis member 104. Thus turning the rods 163 from the position illustrated increases the chassis front end opening.

In each embodiment the lifting mechanism 17 or 117 is designed to provide favourable operating characteristics within the overall movement ratio of about 3 to 1. Thus the arrangement is such that minimum operator effort is required at each end of the range of movement of the lever 118 with the maximum effort being required at the central or horizontal position of the lever. As will readily be appreciated it is in this horizontal position of the lever 118 that opertor effort is most easily applied thereto, particularly by nursing personnel of small stature.

In addition to providing a mechanical advantage the compound lever operating mechanism provides an acceleration diagram of work output which is sinusoidal. This provides maximum mechanical advantage towards the two ends of the operating lever stroke and ensures that the motion felt by the patient is smooth and free of jerks.

The footplate 107 of the embodiment of FIGS. 4 and 5 is detachable, to provide a novel construction of hoist with a chassis which is completely open below knee level. There are many uses for such a hoist which can be wheeled directly over a patient to provide an overhead lift although, as will be appreciated, with the footplate 107 so detached the hoist will not be used to lift a patient to the standing position in accordance with the invention. The method of invention requires that the feet are positively located relatively to the lifting arc of the lifting arm.

Figure 6:
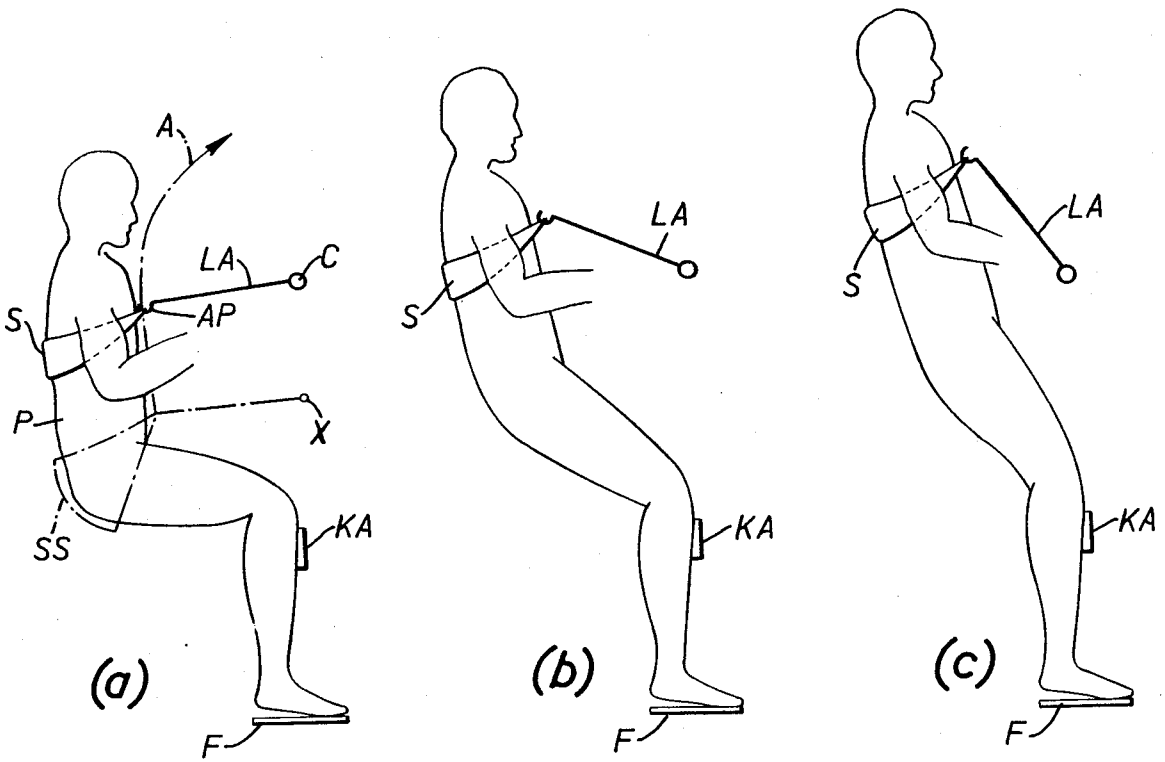
FIG. 6 diagrammatically illustrates three stages in the method of lifting in accordance with the invention employed with the illustrated hoists.

FIG. 6 diagrammatically illustrates the lifting method of the invention as applied with the illustrated hoists. The hoist is brought up to the seated patient P as shown in FIG. 6(*a*) so that the knee abutment means KA locates against the knees of the patient. With the hoist correctly located relatively to the seated patient P, the feet of the latter are placed on the footplate or footrest means F; and the support sling S is passed around the body of the patient P below the armpits and attached to the lifting arm LA of the hoist. Raising of the lifting arm LA, typically through an angle of about 60°, so that the sling attachment points AP move through an arc A about a centre C located relatively to and positioned above the means F, raises the patient P to the standing position shown in FIG. 6(*c*). An intermediate position of the patient P, at the halfway point in the raising movement, is shown in FIG. 6(*b*).

As FIG. 6 clearly shows, a parallelogram lifting action occurs with a substantial part of the patient's body weight is at all times supported through the feet. The four pivot points of the parallelogram are respectively provided by the centre C, the sling attachment points AP, the knees and the hip joint of the patient P. To achieve such an approximately parallelogram movement the length of the lifting arm LA when not adjustable is made approximately equal to the thigh length of an average person. Any necessary adjustment to suit short or tall patients can be achieved by using an appropriate effective length of sling S.

The lifting of an infirm or severely disabled person is illustrated in full lines in FIG. 6, as shown the knee region engaging the abutment means KA at all times even when in the final standing, and slightly backwardly-inclined, position. However, patients with sufficiently muscular strength will involuntarily straighten their legs during lifting so that, in the final position the body is completely straight between the footrests or footplate F and the sling S. Thus for these patients the abutment means KA merely provide location at the initial stage of the lift.

In the fully raised position the lower part of the trunk of the patient is unobstructed, thus allowing clothing removal and treatment of that part. In particular the toileting of clothed patients is facilitated, and one operative can raise the patient, remove and replace outer clothing as necessary and lower underclothing, and position the patient relative to a commode or WC pan on to which the patient is lowered. As previously mentioned, such toileting at present normally requires three attendant operatives and there is no prior hoist available which has found acceptance for use in the toileting procedure. The present invention provides a lifting method and hoists therefor which enable a patient to be toileted comfortably and by a single attendant, with relatively little physical effort on the part of the latter.

FIG. 1(*a*) illustrates in broken lines how a subsidiary seat sling SS may be used beneath the buttocks of the patient P, this subsidiary sling SS being suspended from the attachment points AP and connected to a point X on the hoist which prevents the sling SS slipping up the back of the patient P during lifting. When the fully-raised position is reached the sling SS is detached to leave the lower part of the trunk unobstructed for toileting and the like.

When toileting female patients, after removal of underclothing the wearing of outer garments such as skirts may present a problem as these have to be held up out of the way during positioning relative to, and lowering on to, a commode or WC. When using the seat sling SS this may be detached at the point X and raised up behind the back of the patient P and left in position. Although now not providing any support or impeding clothing removal it can be used to hold up the outer garments which can be tucked underneath this sling. Alternatively an elastic sling around the body may be used, underneath which clothing can be tucked, this elastic sling being provided solely for the purpose of holding skirts and other outer garments up out of the way whilst lowering on to a commode or WC.

A patient with some strength in the arms can grip the hands of the hoists described and thus assist in the raising movement, thus reducing the patient's feeling of dependence and the effort required by the operator. This will also decrease the supporting reaction at the sling S, thereby increasing patient comfort although due to the support of a substantial part of the body weight through the legs and the feet it has been found that in all cases a single padded sling is acceptably comfortable, and in some cases the sling will function largely in a passive role to provide total security.

In the preferred hoist embodiments which have been described and illustrated the footrests (footplate), the knee abutment and the lifting arm pivot all remain stationary and in fixed relative positions. However, it will be clear from a study of FIG. 6 that this is not necessarily so and that various relative movements can be employed to move from the initial condition of FIG. 6(*a*) to the final condition of FIG. 6(*c*), providing the movement of the sling attachment points AP occurs along the arc A relative to the footrests (footplate) F.

Although the hoists described and illustrated have mobile chassis, a hoist in accordance with the invention may be of a static nature, for example having a static pivot mounting so that the hoist as a whole can be swung round about a vertical axis. The patient to be lifted is transported to such a static hoist on a wheelchair, and the hoist may be mounted in a toilet cubicle by a WC.

I claim:

1. A method of lifting a patient from a seated to a substantially standing position employing a hoist with a lifting arm arrangement presenting laterally spaced sling attachment points, comprising a procedure wherein the feet of the patient are positioned on foot support means with the legs below the knees substantially vertical, a sling is passed around the back of the patient underneath the arms thereof and, with said sling attached to said attachment points, said attachment points are moved upwardly along a generally arcuate path relative to the position of the feet which defines an arc having an effective radius comparable to the length of the thigh bones of the patient whereby to raise the latter to a generally standing position on said foot support means while supported and laterally located by the sling, and said arc being centered about a lateral horizontal axis parallel to a line joining said attachment points and to lines respectively joining the centers of pivotal movement of the knee and hip joints of the patient, which axis remains fixed relative to said foot support means and is disposed generally directly above the heel position of the patient with the latter facing said axis.

2. A method according to claim 1, wherein said lateral axis is disposed at a fixed height and said lateral axis is maintained stationary relative to said foot support means during the lifting movement.

3. A method according to claim 1, wherein said sling is of padded form and the width thereof is such that when the patient is raised to the standing position a lower portion of the trunk of the patient is accessible for clothing removal and/or treatment, toileting and the like.

4. A method according to claim 3, wherein the weight of the patient is supported solely by said sling and by the foot support means while the patient is being lifted from the seated to the standing position.

5. A method according to claim 1, wherein the hoist is initially positioned with the knees of the seated patient located against knee abutment means of the hoist.

6. A patient hoist for lifting a seated patient to a standing position comprising an upstanding support structure, a lifting arm arrangement projecting from the support structure and providing laterally spaced attachment points for the attachment of a body support sling positioned around the back of the seated patient below the arms thereof, said attachment points being rigidly located laterally of the arm arrangement which is pivoted about a horizontal axis with the attachment points disposed at a radius comparable to the average length of a human thigh bone, foot support means mounted on said support structure, and a lifting mechanism operative to raise the lifting arm arrangement in such manner that the attachment points thereof move along a generally arcuate path centered on a lateral axis parallel to a line joining said attachment points, such movement of the lifting arm arrangement being sufficient to raise the patient to a standing position with the feet of the latter supporting a substantial part of the total body weight of the patient while the latter is also supported and laterally located in the standing position by said sling.

7. A hoist according to claim 6, wherein said lifting arm arrangement is mounted on said support structure for solely pivotal movement about said horizontal axis by said lifting mechanism, and said support structure is disposed with said horizontal axis disposed generally directly above said foot support means.

8. A hoist according to claim 7, wherein said support structure has a side remote from said lifting arm arrangement and said hoist additionally includes an operating mechanism which comprises an operating lever pivotally mounted about a horizontal axis on said support structure on the side thereof remote from said lifting arm arrangement, and a mechanical coupling between said operating lever and said arm arrangement to provide a mechanical advantage.

9. A hoist according to claim 6, wherein said support structure is mounted on a mobile chassis having a front and rear and comprising spaced chassis side members, said chassis being open at the front between said side members, and said support structure is mounted adjacent the rear of the chassis and comprises a central upper column portion on which said arm arrangement and said lifting mechanism are mounted, and a lower portion of inverted U-shape with side limbs respectively mounted on the chassis side members and an intermediate limb on which said column portion is mounted.

10. A hoist according to claim 6, wherein knee abutment means are mounted on said support structure for location of the knees of the patient.

11. An invalid hoist for lifting a seated invalid to a standing position comprising an upstanding support structure, a pivotal lifting arm arrangement projecting from one side of said support structure and providing laterally spaced attachment points for the attachment of a padded body support sling passed around the back of the invalid below the arms thereof with the attachment points rigidly located laterally of an arm arrangement which is pivotal about a fixed horizontal axis with the attachment points disposed at a radius comparable to the average length of a human thigh bone, knee location abutment means on the support structure, foot support means mounted on said support structure and a lifting mechanism operative to raise the lifting arm arrangement about said horizontal pivot axis through an angle sufficient to raise the patient, with the knees of the latter located against said abutment means, to the standing position on the foot support means while supported from behind and laterally located by the sling.

12. A hoist according to claim 11, wherein the support structure is mounted on a mobile chassis over which the lifting arm arrangement projects, said chassis being of U-shaped form open at the front with the support structure mounted adjacent the rear of the chassis which has side members of adjustable spacing.

13. A hoist according to claim 12, wherein the support structure comprises an upstanding column mounted on the chassis which has a cross member on which the column is centrally mounted, said foot support means being mounted on the cross member on either side of the column.

14. A hoist according to claim 12, wherein the support structure comprises an upper central column portion and a lower portion of inverted U-shape which is mounted on the chassis.

15. A hoist according to claim 14, wherein said lower portion of the support structure has spaced upright members respectively mounted on the chassis side members and said foot support means extends between the chassis side members.

16. A hoist according to claim 15, wherein the chassis side members are pivotally adjustable about the axis of said upright members of said lower portion of the support structure.

17. A hoist according to claim 12, wherein said arm arrangement includes hand grips for the patient.

18. A hoist according to claim 12, wherein said support structure has a side opposite to the lifting arrangement and said lifting mechanism is mechanical and manually operated with an operating lever pivotally mounted at the side of the support structure opposite to the lifting arrangement.

19. A hoist according to claim 18, additionally including a mechanical linkage between the operating lever and the lifting arm arrangement which provides a mechanical advantage.

20. A hoist according to claim 19, wherein the operating lever moves downwardly through substantially 180° to effect an arm lifting movement.

21. A hoist according to claim 20, wherein the arm lifting movement is of the order of 60°–65°.

22. A hoist according to claim 19, wherein said mechanical linkage includes an over-center device such that the lifting mechanism is self-locking in the arm raised position.

23. A hoist according to claim 18, wherein retention means is provided on the support structure to retain the operating lever against accidental displacement when in the patient raised position.

24. A hoist according to claim 18, wherein damping means are provided operative to lower the patient gently if the operating lever is inadvertently released during raising or lowering of the patient.

25. A hoist according to claim 12, wherein the lifting arm arrangement comprises an inner end central portion directly coupled to the lifting mechanism and two laterally spaced outer end portions provided with end sling attachment means and which are spaced apart by a distance which approximates the shoulder width of a typical patient.

26. A hoist according to claim 25, wherein said inner and outer arm portions are relatively articulated for arm height adjustment, via an eccentric rotary cam.

27. A hoist according to claim 12, wherein the lifting arm arrangement is of telescopically adjustable length.

* * * * *

UNITED STATES PATENT AND TRADEMARK OFFICE

CERTIFICATE OF CORRECTION

PATENT NO. : 4,918,771

DATED : April 24, 1990

INVENTOR(S) : David R. JAMES

It is certified that error appears in the above-identified patent and that said Letters Patent is hereby corrected as shown below:

Cover page, column 1, item [73], delete line 1 in its entirety and substitute therefor —Impro Limited—.

Signed and Sealed this

Seventeenth Day of September, 1991

*Attest:*

HARRY F. MANBECK, JR.

*Attesting Officer*

*Commissioner of Patents and Trademarks*